United States Patent [19]

Rietzscher et al.

[11] Patent Number: 5,070,797

[45] Date of Patent: Dec. 10, 1991

[54] PROCESS AND DEVICE TO FEED ADDITIVES INTO A SHAFT OR CUPOLA FURNACE

[75] Inventors: Rolf Rietzscher; Axel Rudolph, both of Mettmann, Fed. Rep. of Germany

[73] Assignee: Georg Fischer AG, Schaffhausen, Switzerland

[21] Appl. No.: 251,375

[22] PCT Filed: Dec. 23, 1987

[86] PCT No.: PCT/CH87/00173

§ 371 Date: Oct. 16, 1989

§ 102(e) Date: Oct. 16, 1989

[87] PCT Pub. No.: WO88/05149

PCT Pub. Date: Jul. 14, 1988

[30] Foreign Application Priority Data

Dec. 24, 1986 [CH] Switzerland ..... 5186/86

[51] Int. Cl.[5] ..... F23K 5/00

[52] U.S. Cl. ..... 110/106; 110/265; 432/99

[58] Field of Search ..... 110/265, 263, 106; 432/99

[56] References Cited

U.S. PATENT DOCUMENTS

| | | | |
|---|---|---|---|
| 3,373,981 | 3/1968 | Taubmann et al. | 432/99 |
| 4,250,816 | 2/1981 | Angevine et al. | 110/106 |
| 4,635,567 | 1/1987 | Haftke et al. | 110/265 |
| 4,655,148 | 4/1987 | Winship | 110/265 |
| 4,665,842 | 5/1987 | Bartsch et al. | 110/265 |
| 4,722,287 | 2/1988 | Anderson et al. | 110/265 |

FOREIGN PATENT DOCUMENTS

| | | |
|---|---|---|
| 1404306 | 5/1965 | France . |
| 1495963 | 9/1967 | France . |
| 2131868 | 11/1972 | France . |
| 2359208 | 2/1978 | France . |

*Primary Examiner*—Henry C. Yuen

*Attorney, Agent, or Firm*—Bachman & LaPointe

[57] ABSTRACT

A process and device for introducing additives, in particular energy carriers, into a cupola or shaft furnace. The additive is carried with combustion air stream and introduced therewith in the furnace shaft, a depression being created at the point where the additive is fed into the combustion air stream, so that the additive is aspirated by the combustion air into the combustion area of the furnace shaft.

5 Claims, 1 Drawing Sheet

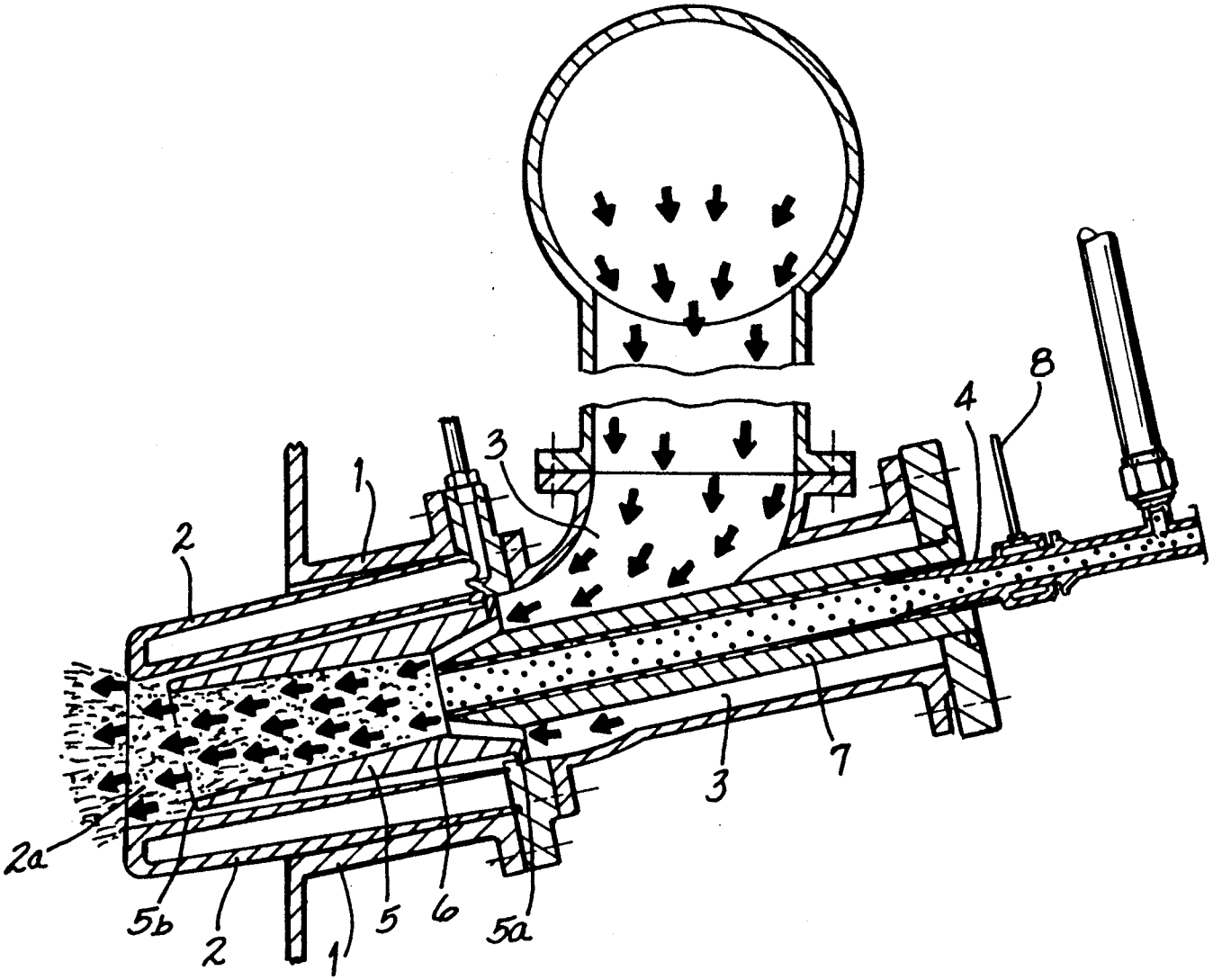
8
4
7
3
3
5a
6
5
1
1
2
2
5b
2a

PROCESS AND DEVICE TO FEED ADDITIVES INTO A SHAFT OR CUPOLA FURNACE

The instant invention relates to a process and to a device to feed at least one additive, in particular an energy carrier into a shaft or cupola furnace in which the combustion air is blown through nozzles into a furnace shaft. The invention also relates to the application of the process and of the device for purposes of waste disposal.

The process of charging additives into a cupola furnace is generally known. Two goals are pursued in this, i.e. the reduction of metallurgical coke consumption as well as the control of the operation of a cupola furnace.

In considering the known technical devices used to inject additives in a metallurgical process it appears that because of a double effect of pressure drop and temperature rise at the output point of the injector, the additives to be charged can be fed into the combustion chamber of the cupola furnace only to an insufficient extent.

DE-OS 31 09 111 discloses an installation for the charging of coal into metallurgical process containers with a plurality of blow-in points and an equal number of injection circuits leading to the blow-in points. In order to avoid irregularity in charging fine-grained combustibles into a cupola furnace for example, each injection circuit is provided with voluminous regulating and control devices in this installation. In addition, the fine-grained combustibles are guided in the feeding ducts to the inlet to the combustion chamber by means of a conveying medium.

A process for charging at least one additive, in particular an energy carrier into a furnace is known from DE-PS 154585. In this case the additive is guided into the combustion air stream and is brought together with the latter into the furnace shaft, whereby the additive is sucked into the furnace as a result of a negative pressure being produced immediately at the outlet point of the additive.

This proposal from the year 1903 could not thereafter be used on an industrial scale.

Suction alone is insufficient because:

a) a change of the internal furnace resistance can cause the negative pressure to collapse, b) certain regulating processes in the gas exhaust system can cause a counter-pressure to be constituted, causing the negative pressure in the suction pipe to collapse.

This situation can lead to clogging in the coal dust supply section.

In order to avoid the expensive and very delicate control and regulating mechanisms while nevertheless ensuring continuous, even feeding of energy carriers into a metallurgical combustion process, the applicant has endeavored to simplify the known installations while increasing the degree of effectiveness.

This objective has been achieved by a process according to the instant invention in which the additive used is guided into the combustion air stream and is brought together with it into the furnace shaft, whereby the additive is sucked from the combustion air stream into the furnace shaft through the production of a negative pressure immediately at the outlet point of the additive.

The installation proposed to carry out the process is characterized by an arrangement of injection nozzles which are provided in the supply circuit of the combustion air stream and is equipped with a pipe line around which the combustion air flows, whereby one end is connected to a supply container with the additive and the other end projects into a narrowing zone of the cross-section of the passage channel going into the furnace wall.

Additional advantageous designs of the process according to the invention and of the device are indicated in the sub-claims.

A preferred embodiment is explained in greater detail through the attached drawing.

The drawing shows a furnace wall 1 of a shaft or cupola furnace (not shown) at which the combustible is charged at the upper end of the shaft. The combustible travels through the pre-heating zone which is heated by the combustion gases and finally reaches the combustion zone below. In the combustion zone of the shaft, a series of feeding circuits are installed around the circumference, and the combustion zone is supplied through them with hot air. This hot air, which serves at the same time as an oxidation means, enters the combustion zone very rapidly, i.e. generally at a speed from 200 to 300 meters/second.

An insert 2, made preferably of a metallic material, with a passage channel 2*a* is installed in the furnace wall 1. A feeding circuit 3 designed to feed hot air or hot wind into the combustion zone, ends in a recess of insert 2. An injector nozzle 7 is installed in the feeding channel 3. The injector nozzle 7 is supplied via feeding pipe 4 with a given additive. This is an open conveying system which operates without assistance from a conveying means. Merely a dosage device (not shown) ensures continuous feeding of the additive.

An insert 5 is provided in the passage channel 2*a*. The passage cross-section of the insert 5 widens from a minimum radius 6 to the openings 5*a* and 5*b*.

The end of the injector nozzle extending into the furnace reaches into the area with the narrowest cross-section of the passage channel of the insert 5. At the narrowing of the cross-section which is defined by diameter 6 a constant negative pressure is produced. This negative pressure produces a suction effect so that the additive fed through injector nozzle 7 is sucked out of the nozzle and into the zone of negative pressure. Since the speed of the hot wind flowing around the injector nozzle is increased near the cross-section narrowing, the additive is conveyed into the combustion zone of the furnace shaft at the speed of the hot wind.

To ensure that changes in pressure which may occur do not lead to clogging, the installation must be assisted by an additional injector system 8 to ensure that a predetermined amount of additive, e.g. carbon (C) always reaches the combustion zone in the furnace. The injector system 8 is assisted by compressed air in its operation, whereby the compressed air can be pre-heated.

The described suction system can easily be used in continuous operation and also be charged in a controlled manner with different consistencies such as fine dust and granulates.

In the described process, coal dust and granulates up to a grain size of 10 mm can be used as additives. The process also makes it possible to use problem materials which must be burned below certain temperatures to avoid undesirable emissions to be released into the environment.

The application of the process and of the device according to the invention can lead to a reduction of 30% and more of the normally used proportion of combustible, i.g. coke.

The described system is also suited for the waste disposal of harmful substances.

The following harmful substances have been considered (and have in part already been tested with success) with respect to waste disposal:

Calcium carbide slake

Old casting sands and core wastes

Filter dust from cupola furnaces, knock-off points and other locations where it occurs, grinding dust, oily shavings and other plant-originated, i.e. casting waste dump and problem materials, and also harmful substances from outside (fly ash, used oils) or a combination of both plant-originated and outside harmful substances, e.g. spongy combustibles such as petroleum coke or graphite soaked with liquid wastes (e.g. capacitor oil) or waste dust and phenol-containing or hydrocarbon-containing problem substances mixed with fly ash or oil-containing waste dump substances.

We claim:

1. A device for charging a mixture of air in a combustible additive into a furnace comprising:

(a) a first insert extending through a wall of said furnace, said first insert defining a channel having a material inlet and a material outlet;

(b) a second insert disposed within said channel, said second insert comprises a venturi tube having a constriction between the material inlet and the material outlet; and (c) an injection nozzle disposed in said venturi and including an additive outlet which terminates proximate to said constriction, said injection nozzle defining with said venturi a first air feeding means which terminates proximate to said constriction and surrounds said additive outlet wherein the constriction produces a pressure drop in the venturi so as to suck additive from said injection nozzle and mix the additive with air in said venturi prior to discharging said mixture into said furnace.

2. The device of claim 1 further comprising second air feeding means leading into said injection nozzle for blowing air into said injection nozzle.

3. The device of claim 1 wherein said additive comprises a powdered material.

4. The device of claim 1 wherein said additive comprises coal dust.

5. The device of claim 1 wherein said additive comprises a combustible waste material.

* * * * *